US005099726A

United States Patent [19]

Hsiao

[11] Patent Number: 5,099,726

[45] Date of Patent: Mar. 31, 1992

[54] HAND TOOL FOR MOUNTING/DISMOUNTING BICYCLE CRANKS

[76] Inventor: K. H. Hsiao, No. 4, Lane 11, Tze Chiang St., Tu Cheng Shiang, Taipei Shien, Taiwan

[21] Appl. No.: 676,295

[22] Filed: Mar. 28, 1991

[51] Int. Cl.[5] ..... B25B 23/00

[52] U.S. Cl. ..... 81/459; 81/437; 81/439; 81/177.2

[58] Field of Search ..... 81/437–439, 81/459, 177.2

[56] References Cited

U.S. PATENT DOCUMENTS

| | | | |
|---|---|---|---|
| 4,070,932 | 1/1978 | Jeannotte | 81/177.2 |
| 4,580,469 | 4/1986 | Lordahl | 81/439 X |
| 4,691,599 | 9/1987 | Schultz | 81/177.2 |
| 4,960,017 | 10/1990 | Hsiao | 81/459 |

*Primary Examiner*—James G. Smith
*Attorney, Agent, or Firm*—Bacon & Thomas

[57] ABSTRACT

In a hand tool for mounting and dismounting bicycle cranks of the type comprising a handle having a hexagonal hole alternatively mounted on a hexagonal collar at the middle of a bolt, which has a hexagon socket at one end and an outer thread portion at an opposite end, or a hexagonal neck at one end of a nut, which has an outer thread portion and is movably mounted on said bolt, to drive said bolt or nut to rotate, wherein said handle has a hexagonal stub tenon, a wedgelike projecting strip and one pair of stub rods respectively made at one end driving a variety of crank fastening caps having different shape of driving tool mounting hole; said bolt has a front rod in relatively smaller outer diameter movably attached with a circular block to protect the front end of the outer thread portion of said bolt. The handle is extendible so that the arm of force can be increased for labor-saving operation.

3 Claims, 4 Drawing Sheets

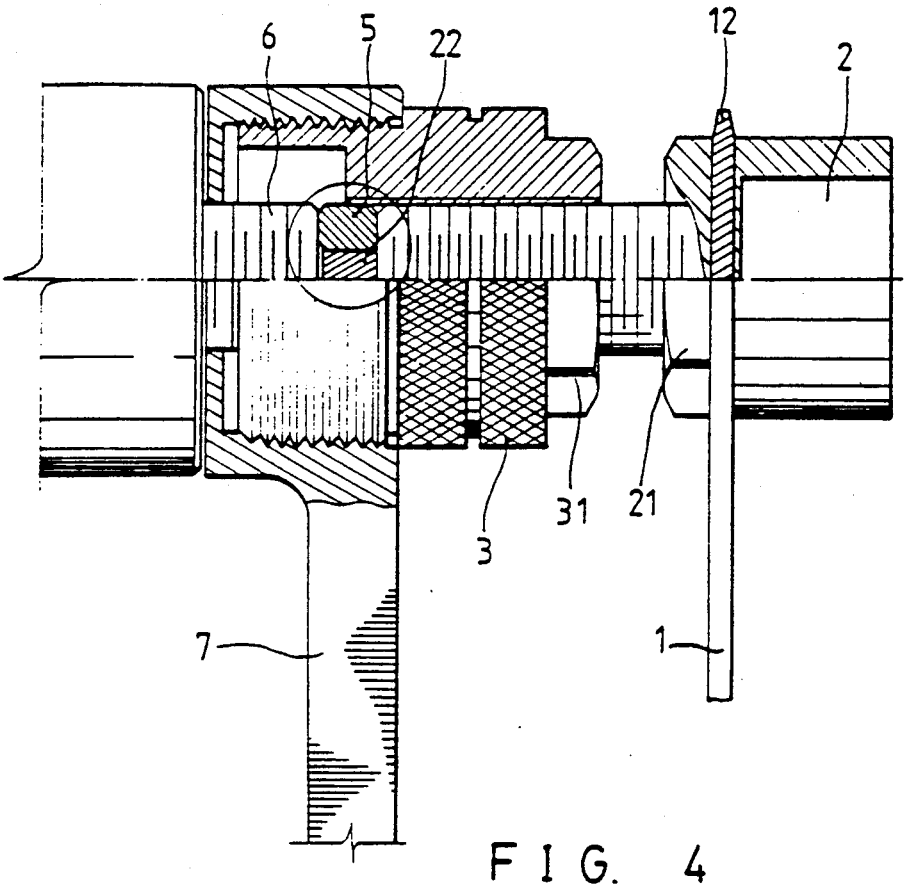
FIG. 4
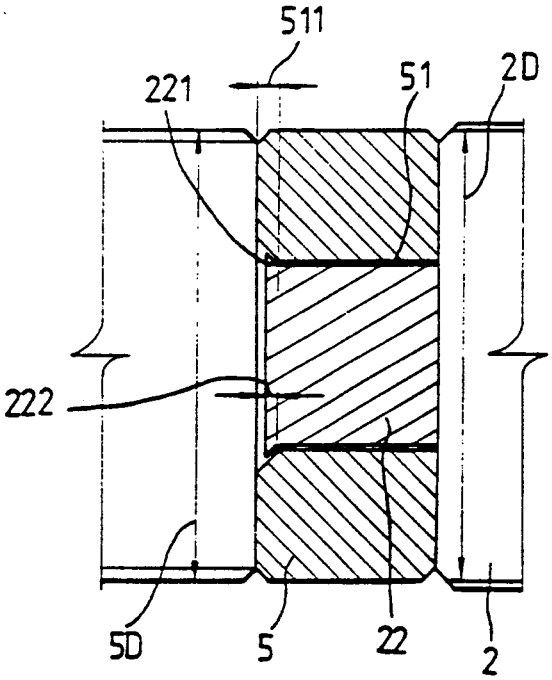

HAND TOOL FOR MOUNTING/DISMOUNTING BICYCLE CRANKS

BACKGROUND OF THE INVENTION

The present invention relates to hand tools and relates more particularly to a hand tool for mounting or dismounting bicycle cranks which has means for removing a variety of crank fastening caps from place, means to protect the front end of the outer thread portion of the bolt thereof, and means to extend the arm of force for labor-saving operation.

In U.S. Pat. No. 4,960,017, there is disclosed a hand tool specifically designed for mounting or dismounting bicycle cranks. This device is very convenient in use. However, the front end of the outer thread of the bolt may be damaged easily when the bolt is stopped against the bottom bracket bearing axle of a bicycle during crank dismounting operation.

SUMMARY OF THE INVENTION:

The present invention has been accomplished to eliminate this problem. According to a first aspect of the present invention, there is provided a hand tool for mounting and dismounting bicycle cranks, comprising a handle having a hexagonal hole alternatively mounted on a hexagonal collar at the middle of a bolt, which has a hexagon socket at one end and an outer thread portion at an opposite end, or a hexagonal neck at one end of a nut, which has an outer thread portion and is movably mounted on said bolt, to drive said bolt or nut to rotate, wherein said handle has a hexagonal stub tenon, a wedge-like projecting strip and one pair of stub rods respectively made at one end driving a variety of crank fastening caps having different shape of driving tool mounting hole. According to a second aspect of the present invention, the hand has two stop rods bilaterally disposed at one end, two stop blocks bilaterally disposed at an opposite end, and a sliding sheath longitudinally movably attached thereto, wherein the sliding sheath is stopped by said stop blocks when it is extended from the handle to the extent, or stopped by said stop rods when it is drawn up to the handle. According to a third aspect of the present invention, the bolt has a front rod concentrically disposed at the front end thereof and movably attached with a circular block to protect the outer thread of the bolt against damage when the bolt is inserted in a bicycle crank for removing it from place.

BRIEF DESCRIPTION OF THE DRAWINGS:

FIG. 4 are partly sectional drawings of the hand tool in enlarged scale showing the structure of the circular block and the front rod of the bolt;

Figure 1:
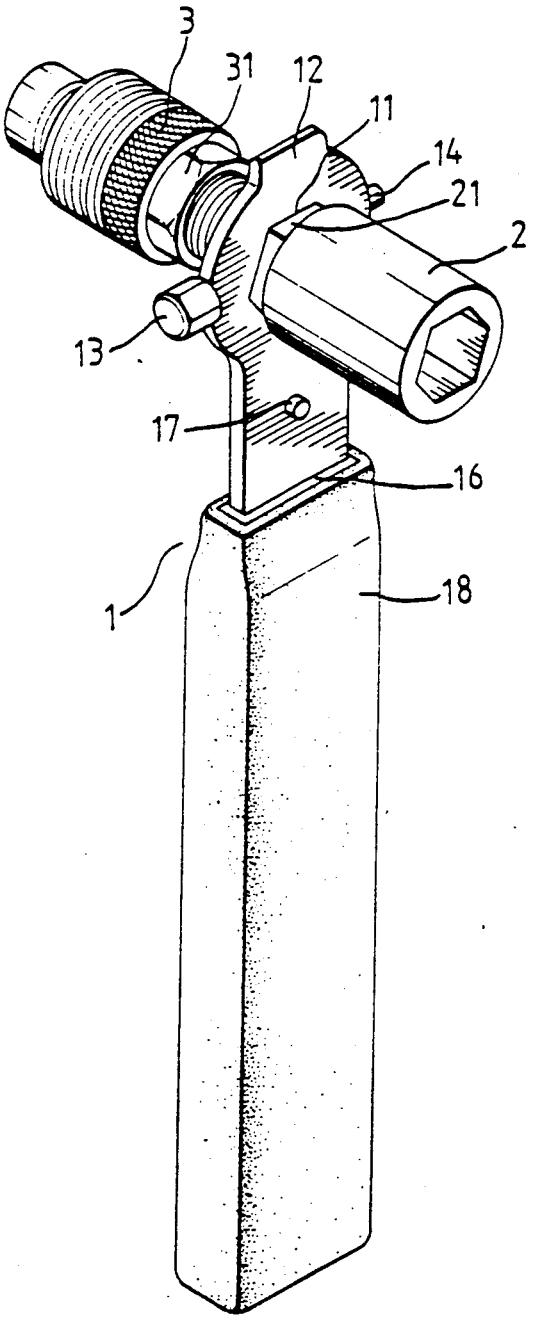
FIG. 1 is a perspective view of the preferred embodiment of the hand tool of the present invention.
Figure 2:
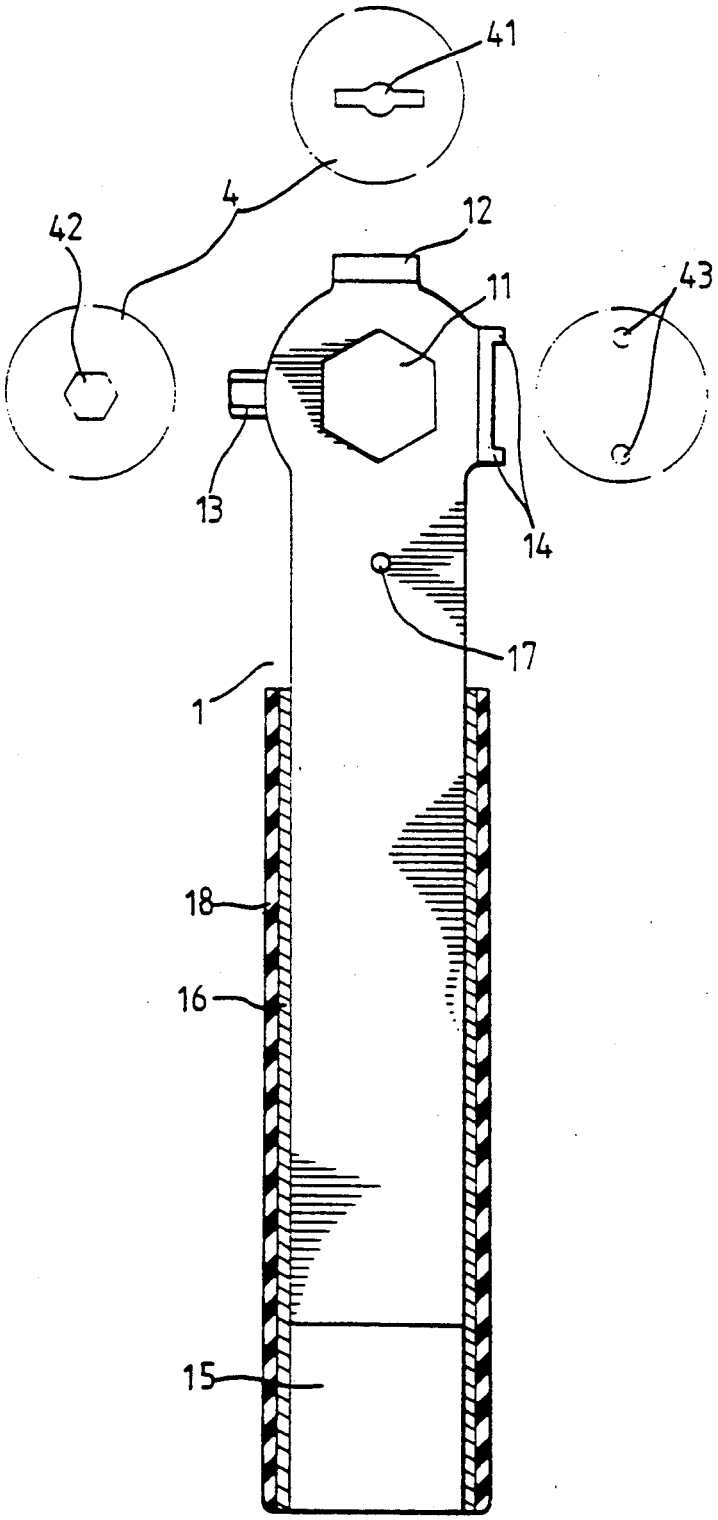
FIG. 2 a sectional side view thereof.

DETAILED DESCRIPTION OF THE PREFERRED EMBODIMENT:

Referring to FIG. 1, there is provided a hand tool specifically designed for mounting or dismounting bicycle cranks which is generally comprised of a handle 1 and a bolt 2 and a nut 3. The bolt 2 has an outer thread body portion at one end, a hexagonal collar portion 21 at the middle and a hexagon socket portion at an opposite end. The nut 3 is movably mounted on the outer thread body portion of the bolt 2 through screw joint, having a hexagonal neck portion 31 extending from an externally threaded body portion. The handle 1 has a hexagonal hole 11 piercing through the face near the front end thereof alternatively mounted on the hexagonal collar portion 21 or the hexagonal neck portion 31 to drive the bolt (hexagonal socket) 2 or the nut 3 to rotate. The handle 1 further comprises a projecting strip 12, a hexagonal stub tenon 13 and two opposite stub rods 14 respectively projecting outwards from the front end thereof, wherein said projecting strip 12 is made at the front end, said hexagonal stub tenon 13 is made at at one side, and said two opposite stub rods 14 are respectively made at an opposite side at two opposite locations. The projecting strip 12, the hexagonal stub tenon 13 and the stub rods 14 are respectively provided for removing any of a variety of crank fastening caps which may have a hexagonal hole 42, a slotted hole 41 or a plurality of holes 43 thereon for mounting a driving tool (see FIG. 2).

Figure 3:
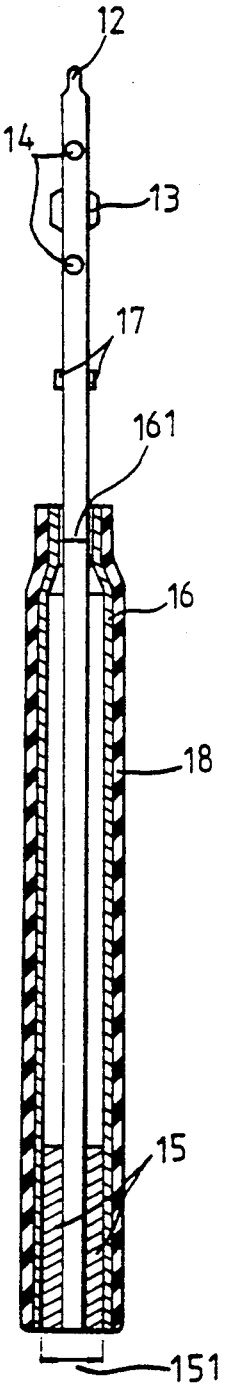
FIG. 3 is a sectional front view thereof.

Referring to FIG. 3, the handle 1 has two stop blocks 15 bilaterally disposed at the bottom end thereof and covered inside a sliding sheath 16 which can be moved to slide on the handle 1 along longitudinal direction so to to extend the arm of force of the handle 1 during driving operation. The sliding sheath 16 has a narrower front end defining an opening in width 161 narrower than the thickness 151 of the handle 1 including the two stop blocks 15. When the sliding sheath 16 is extended from the handle 1 to a maximum extent, the narrower front end of the sliding sheath 16 is stopped by the stop blocks 15 and therefore, the sliding sheath 16 does not disconnect from the handle 1. The handle 1 further comprises two stop rods 17 near the hexagonal hole 11 thereof and bilaterally projecting outwards to define the upper stroke of the sliding sheath 16 relative to the handle 1. For comfort gripping, the sliding sheath 16 is covered with a layer of flexible material 18.

Figure 5:
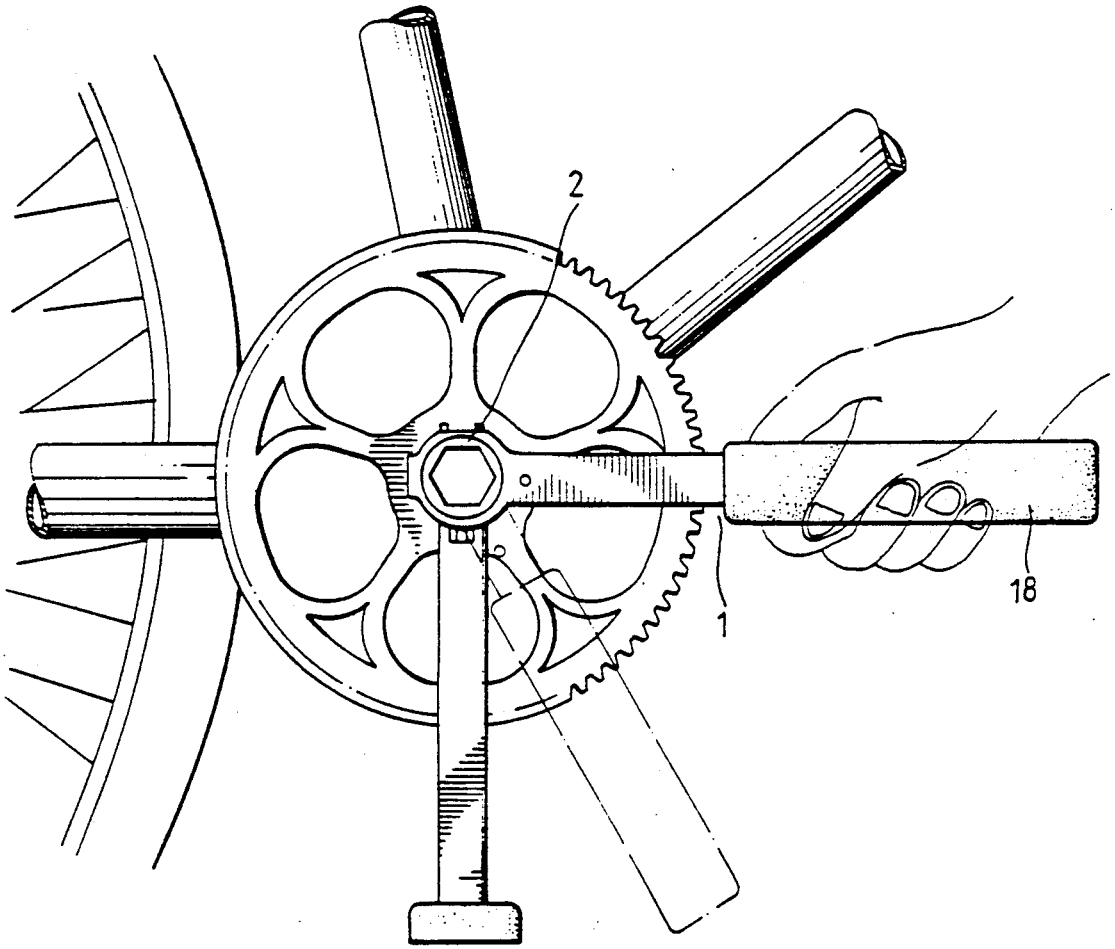
FIG. 5 is a front view illustrating the use of the present invention in fastening a bicycle crank wherein the handle is in an extended state so that the hand in operation is protected from touching the chain wheel.

Referring to FIG. 5, because the total length of the handle 1 is extendible, longer arm of force is provided for labor-saving operation and, the hand which holds the tool is protected from touching the chain wheel of the bicycle.

Referring to FIG. 4, another structural feature of the present invention is that the bolt 2 has a front rod 22 at the front end opposite to the hexagon socket thereof in relatively smaller outer diameter and attached with a circular block 5 which has an outer diameter 5D relatively smaller than the minor outer diameter 2D of the outer thread portion of the bolt 2 and defines therein a boring bore 51 for mounting said front rod 22. The outer orifice 511 of the boring bore 51 of the circular block 5 is relatively wider, forming into a horn-like structure. After the circular block 5 has been mounted on the front rod 22 of the bolt 2, the front end of the front rod 22 is processed into a flange 221 to stop the circular block 5 from disconnection. The thickness 222 of the flange 221 of the front rod 22 is shorter than the depth of the outer orifice 511 and therefore, the outer end of the front rod 22 is protected inside the circular block 5. When the hand tool is used to dismount a bicycle crank 7 from the bottom bracket bearing axle 6 of a bicycle, it is not necessary to stop the front end of the bolt 2 against the bottom bracket bearing axle 6, but instead, the circular block 5 is stopped against the bottom bracket bearing axle 6 permitting the nut 3 to drive said bicycle crank 7 to rotate relative to the bottom bracket bearing axle 6. Therefore, the outer thread of the bolt 2 is protected from damage.

What is claimed is:

1. A hand tool for mounting and dismounting bicycle cranks, comprising:

a bolt having an outer thread portion at one end, a polygonal collar at the middle, and a polygonal socket at an opposite end;

a nut movably mounted on the outer thread portion of said bolt, having a polygonal neck portion at one end adjacent to said polygonal collar and an outer thread portion around the outer wall surface thereof;

a handle having a polygonal hole at one end alternatively mounted on said polygonal collar or said polygonal neck to drive said hexagon socket or said nut to rotate; and characterized in that;

said handle has a hexagonal stub tenon, a wedge-like projecting strip and one pair of stub rods respectively made at one end around said polygonal hole and disposed at the same plane for driving different crank fastening caps having different shape of driving tool mounting hole, and two stop blocks bilaterally disposed at an opposite end and covered inside a sliding sheath, said sliding sheath being to slide on said handle along longitudinal direction so as to extend the arm of force of said handle and having a narrower front end defining an opening in width narrower than the total thickness of said two stop blocks for stopping said handle from disconnection.

2. The hand tool of claim 1, wherein said bolt has a front rod concentrically longitudinally extending from the outer thread portion thereof at the front in outer diameter relatively smaller than said bold and a circular block revolvably mounted on said front rod, said front end having a flange at an outer end, said circular block having an outer diameter relatively smaller than the minor outer diameter the outer thread portion of said bolt and a boring bore through the central axis thereof for mounting said front rod, said boring bore having a horn-like orifice extending outwards at one end opposite to said nut and said polygonal socket, said horn-like orifice being made in depth longer than a thickness of said flange permitting said flange to be protected inside said circular block.

3. The hand tool of claim 1, wherein said handle has two projecting rods bilaterally projecting outwards at two opposite locations adjacent to said polygonal hole to limit the moving range of said sheath when said handle is received inside said sheath.

* * * * *